US007487557B2

(12) United States Patent
Bellfy

(10) Patent No.: US 7,487,557 B2
(45) Date of Patent: Feb. 10, 2009

(54) ATTACHMENT OF PROTECTIVE PADS FOR PROTECTION OF JOINT SURFACES

(75) Inventor: Paul I. Bellfy, 127 S. John Hix St., Westland, MI (US) 48186

(73) Assignee: Paul I. Bellfy, San Marcos, CA (US)

( * ) Notice: Subject to any disclaimer, the term of this patent is extended or adjusted under 35 U.S.C. 154(b) by 0 days.

(21) Appl. No.: 10/925,681

(22) Filed: Aug. 25, 2004

(65) Prior Publication Data

US 2005/0066428 A1 Mar. 31, 2005

(51) Int. Cl.
*A41D 13/00* (2006.01)

(52) U.S. Cl. ..... 2/465

(58) Field of Classification Search ..... 2/23, 2/465, 467, 92, 267, 227, 228, 22, 24, 16, 2/69, 911, 455, 456, 46, 2.5, 62, 242, 919
See application file for complete search history.

(56) References Cited

U.S. PATENT DOCUMENTS

| | | | | | |
|---|---|---|---|---|---|
| 891,533 | A | | 6/1908 | Gibbs | |
| 2,889,830 | A | * | 6/1959 | Raymond | 450/98 |
| 3,484,868 | A | * | 12/1969 | Davenport, Jr. | 2/465 |
| 4,317,237 | A | * | 3/1982 | Porte | 2/464 |
| 5,134,726 | A | | 8/1992 | Ross | |
| 5,365,610 | A | | 11/1994 | Lubahn | |
| 5,551,082 | A | * | 9/1996 | Stewart et al. | 2/465 |
| 5,584,072 | A | * | 12/1996 | Kim et al. | 2/465 |
| 5,617,587 | A | * | 4/1997 | Marchbanks | 2/247 |
| 5,918,310 | A | | 7/1999 | Farahany | |
| 5,946,732 | A | * | 9/1999 | Richards | 2/247 |
| 6,408,446 | B1 | | 6/2002 | Carrington | |
| 6,532,599 | B1 | | 3/2003 | Dugan | |
| 6,704,938 | B2 | | 3/2004 | Crockett | |
| 6,745,406 | B2 | * | 6/2004 | Ruane | 2/465 |
| 6,854,129 | B2 | * | 2/2005 | Mazzarolo | 2/23 |

* cited by examiner

*Primary Examiner*—Tejash Patel

(57) ABSTRACT

A single or plurality of fasteners attached spaced along dynamic center and general periphery of a protective pad, such as a hip or coccyx pad, to releaseably secure the pad, through a small hole or holes in ordinary clothing, at the bodily joint to be protected. The fasteners being capable of applying a clamp load to the clothing without damaging the material of the clothing, wherein one part of the fastener having a head with a cylindrical nut inserted through a hole in the protective pad and the other part of the fastener having a headed screw inserted through a hole in the clothing to allow the protective pad to be quickly secured to the inside or outside of the clothing. The ordinary clothing is then suited as impact protection for use in high impact sports activities.

6 Claims, 4 Drawing Sheets

ATTACHMENT OF PROTECTIVE PADS FOR PROTECTION OF JOINT SURFACES

BACKGROUND OF THE INVENTION

1. Field of the Invention

The present invention pertains to a method and apparatus for releaseably mounting protective padding to the inside or outside of ordinary clothing for protection of joint surfaces and, more particularly to mounting protective padding to the clothing in such a fashion as to avoid damaging the clothing and, without binding movement of the bodily joint.

2. The Prior Art

There are many instances in life and instances while participating in sports activities where it is desirable and/or necessary to have protective pads for protection of underlying bodily joint surfaces. To date there has been no way to keep protective pads in place on the hips and the lower back without requiring extensive modification to the clothing or requiring garments which encircle the body. The garments have a tendency to restrict movement and require the user to add an extra layer of clothing to their existing attire. Undergarments tend to have relatively thin pads due to flexibility requirements and this translates to less impact protection.

Another aspect of existing protective pads for protection of the hips and lower back is that padded apparatus for applications such as football and hockey maintain a high quality of impact protection but are highly visible to the onlooker. In sports such as skateboarding, skating, in-line skating, and mountain biking, highly visible pads for protection of the hip and lower back areas are not accepted due to the perceived "image" expected in these sports.

A very old method for securing pads is described in U.S. Pat. No. 891,533 to Gibbs where the upper portion of the pneumatic knee-pad is secured from the outside of the trousers with safety pins. The obvious drawback to this method of attachment as applied to high impact sports is that safety pins allow substantial movement of the pad with respect to the clothing and could literally cause the clothing to rip apart upon impact. Another drawback is that the metallic safety pin will distort beyond further use upon impact.

U.S. Pat. No. 6,408,446 Carrington; U.S. Pat. No. 5,551,082 Stewart, et al.; U.S. Pat. No. 5,134,726 to Ross; and U.S. Pat. No. 6,532,599 Dugan are representative of the many patents which use pockets in the application of specialized clothing to retain the protective pads to the clothing to protect the hip and/or lower back portions of the body. The pads are removable due to the nature of the pockets, but require an additional, specialized article of clothing with pocket features to achieve the desired result.

U.S. Pat. No. 5,918,310 Farahany discloses a quickly removable garment via zipper features, employing pockets for removable hip pads for application to the elderly. The pads are removable due to the nature of the pockets and require a specialized article of clothing with pocket features to achieve the desired result. This patent is cited separately due to the time averaged low impact nature of the application.

U.S. Pat. No. 5,365,610 Lubahn, et al. discloses an outer garment with hip and knee pockets for use in the sport of baseball. The pads require a specialized article of clothing with pocket features to achieve the desired result. The inventors contemplate sewing the pad to the pocket in a central location on the pad so as to allow many degrees of freedom of movement with respect to the pocket. The idea of multiple degrees of freedom of movement is academically stimulating, but the fact remains that a specialized garment is necessary to implement the desired result.

U.S. Pat. No. 6,704,938 Crockett discloses a knee and elbow pad with spring loaded opposing gripping jaws to attach the protective pad to the outside of the clothing. The pads are removable due to the nature of the gripping jaws. This type of gripping jaw and pad configuration is suited for the worker in less dynamic situations. In high impact sports, the participant would be injured when falling on the gripping jaws. In addition, the pads are made to be secured to the outside of the clothing and not to the inside.

None of the above patents shows or suggests the present invention which provides a method and apparatus for releaseably attaching protective padding to ordinary clothing through a small hole or holes in the clothing, the pad being capable of being attached either inside the clothing or outside the clothing. All of the prior art either requires modified clothing with pocket features to hold the pads in the modified clothing or requires gripping jaws to attach the pad to the outside of the clothing, the gripping jaws being unsuitable for high impact sports.

BRIEF SUMMARY OF THE INVENTION

The purpose of the present invention is to provide impact protection for a bodily joint, with a pad easily attached and detached from ordinary clothing, for use in high impact sports.

The present invention provides a single or plurality of fasteners attached spaced along dynamic center and general periphery of a protective pad, such as a hip or coccyx pad, to releaseably secure the pad, through a small hole or holes in ordinary clothing, at the bodily joint to be protected. The fasteners being capable of applying a clamp load to the clothing without damaging the material of the clothing, wherein one part of the fastener having a head with a cylindrical nut inserted through a hole in the protective pad and the other part of the fastener having a headed screw inserted through a hole in the clothing to allow the protective pad to be quickly secured, via rotation between the headed screw and the cylindrical nut, to the inside or outside of the clothing.

DETAILED DESCRIPTION OF THE INVENTION

Figure 1:
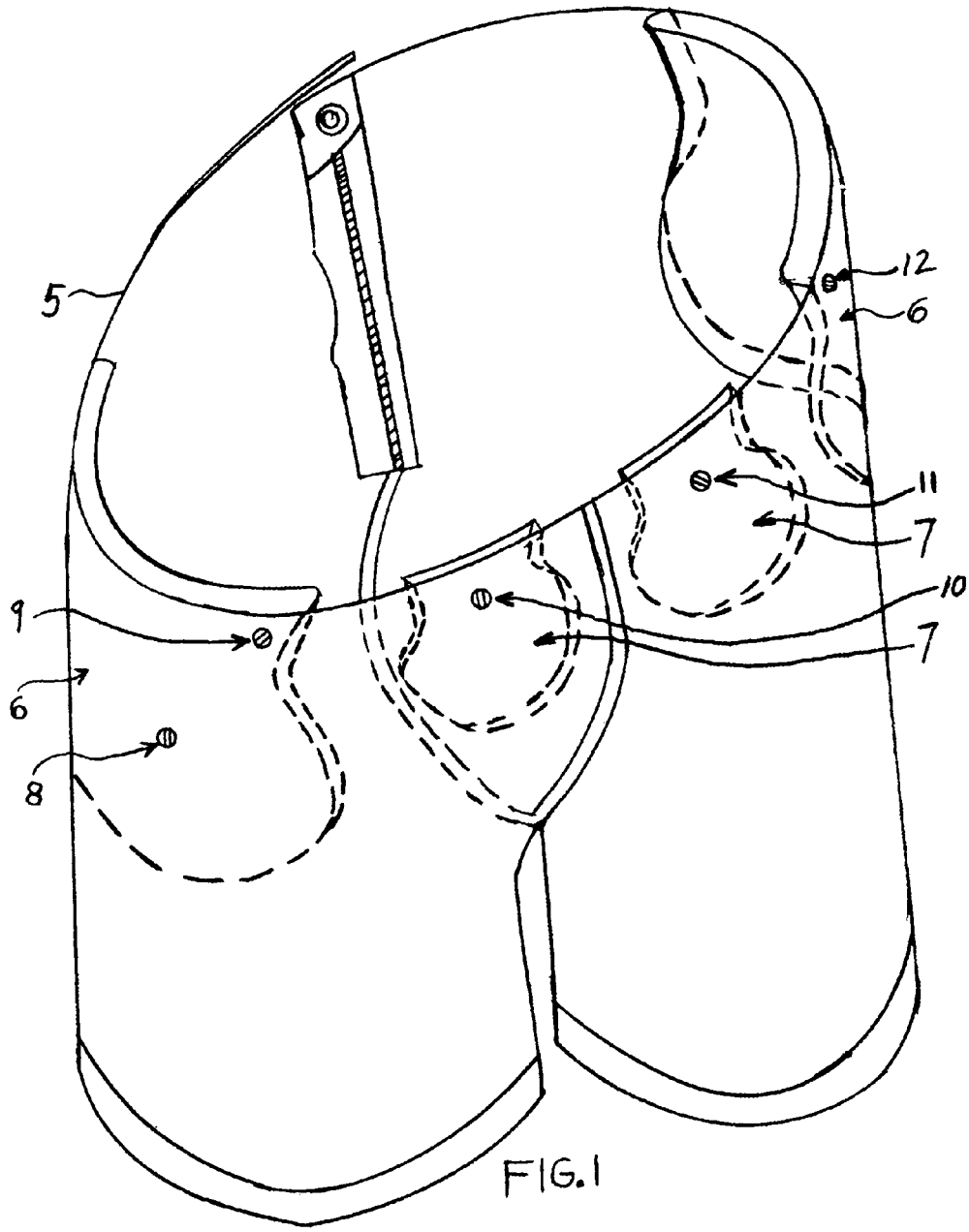
FIG. 1 is a perspective view showing the present invention in use holding the hip and coccyx pads in place.

FIG. 1 shows the ordinary clothing 5, such as a pair of shorts, to which the hip pads 6 and coccyx pads 7 have been attached using the principles of the present invention. The pads 6, 7 are provided with a plurality of headed screws 8, 9, 10, 11, 12 attached along the dynamic center and general periphery of the pads 6, 7. Each headed screw 8, 9, 10, 11, 12 is adapted to be attached to the clothing in such a fashion as to hold the pads 6, 7 in place while not damaging the clothing. A fastener generally comprises any one of the headed screws 8, 9, 10, 11, 12, 13, 14 and any one of the cylindrical nuts 15, 16, 17, 18. Any one of the cylindrical nuts 15-18 completely covers any one of the headed screws 8-14.

Figure 2:
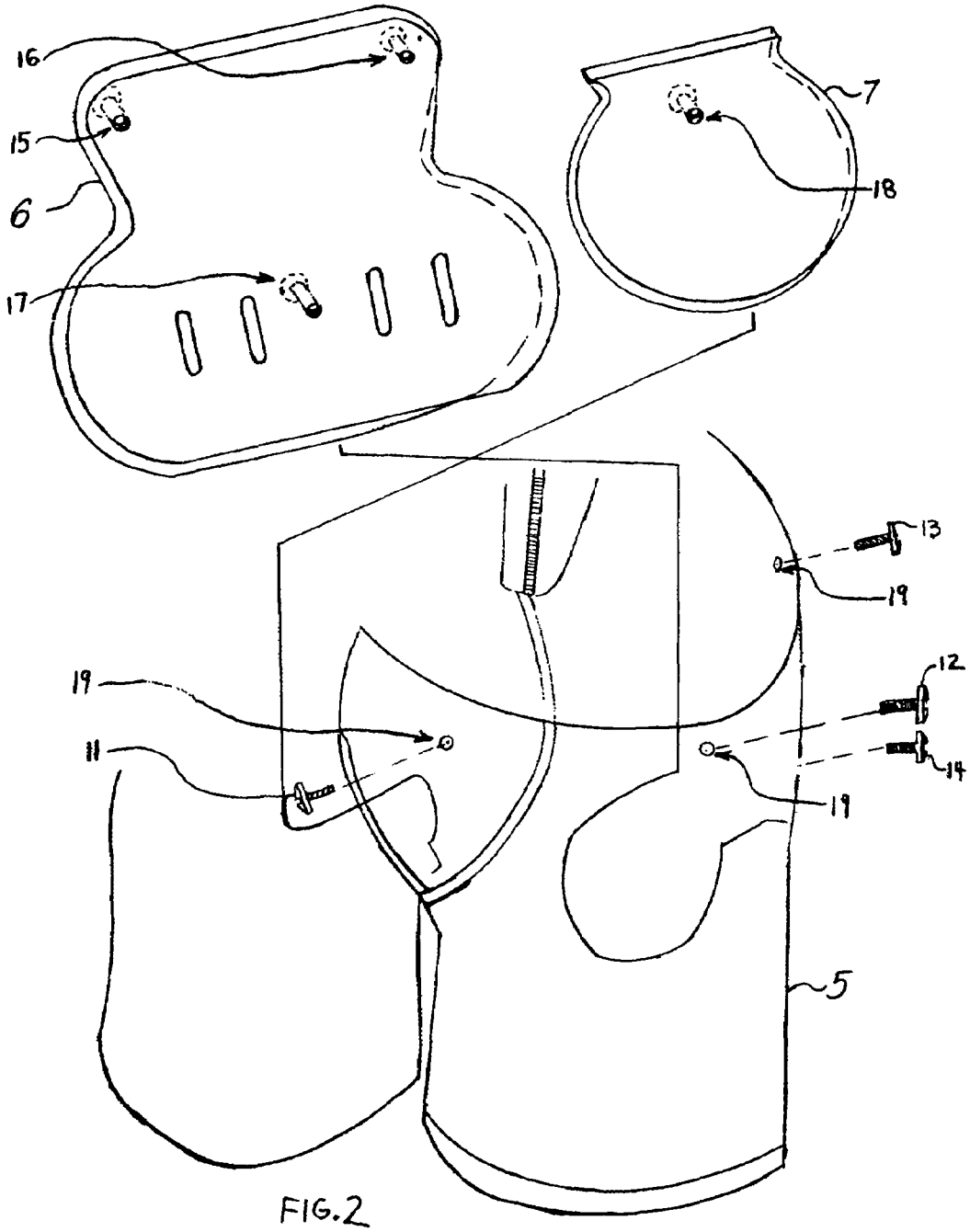
FIG. 2 is a perspective view showing the pads, fasteners, and clothing attachment details.

FIG. 2 shows the ordinary clothing 5, the hip pad 6, the coccyx pad 7, and the location of attachment of the pads 6, 7 in the ordinary clothing 5. The headed screws 11, 12, 13, 14 pass through the holes in the clothing 19, and attach to the cylindrical nuts 15, 16, 17, 18 via rotation of the headed screws 11, 12, 13, 14 to secure the pads 6, 7 to the clothing 5.

Figure 3:
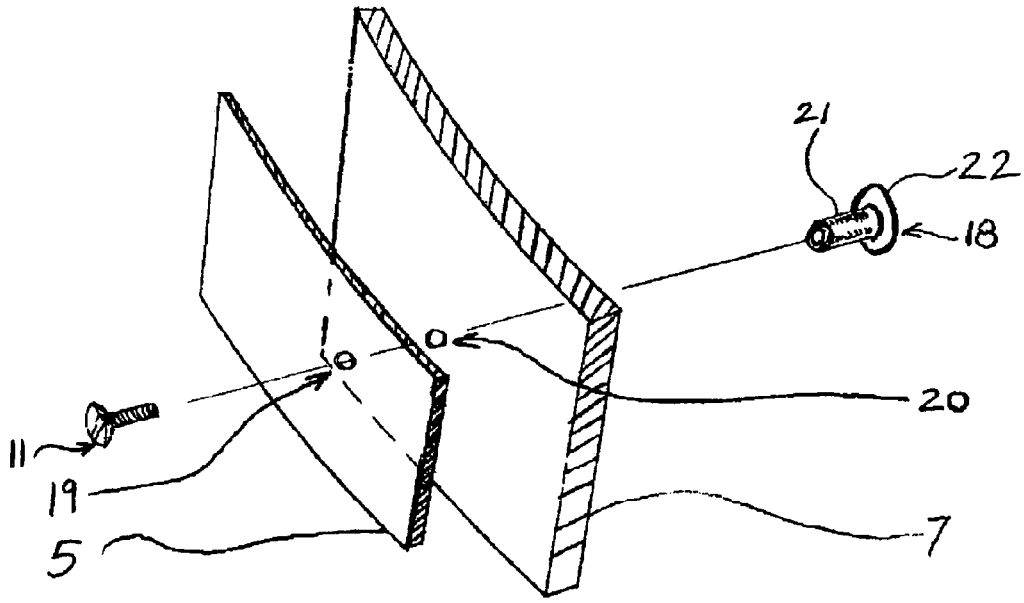
FIG. 3 is a perspective view showing the details of the fastener attachment to clothing and pads.

FIG. 3 shows the ordinary clothing 5, the pad 7, and the installation of the headed screw 11, through the hole in the ordinary clothing 19. The cylindrical nut 18 is inserted into the hole in the pad 20 and the headed screw 11 is secured through the hole in the clothing 19 via clockwise rotation. As stated above the cylindrical nut 18 completely covers the headed screw 11 when the headed screw 11 is fully engaged with the cylindrical nut 18. The cylindrical nut generally comprises a shaft 21 and an end cap 22.

Figure 4:
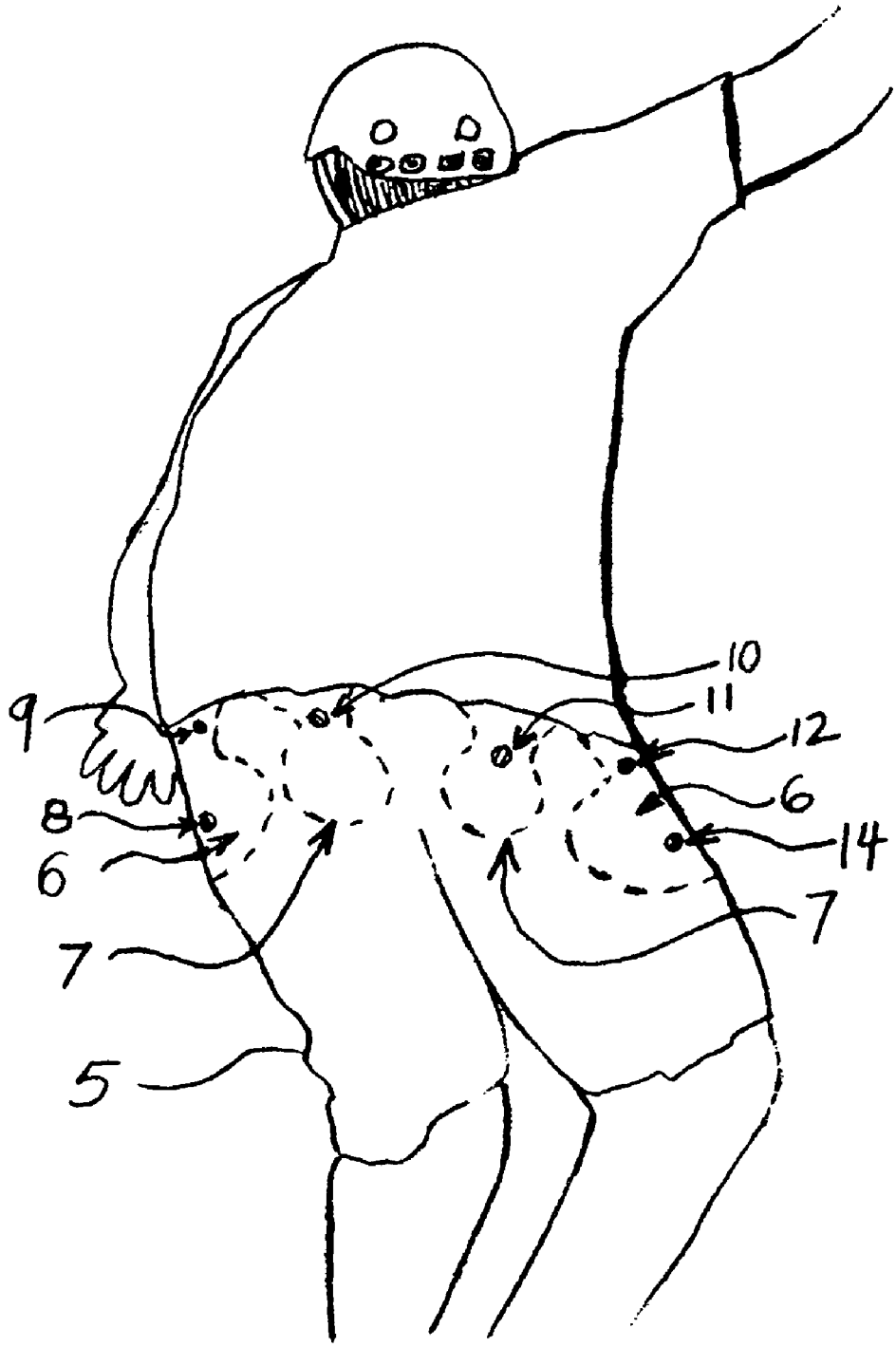
FIG. 4 is a perspective view showing the present invention in use in a dynamic situation.

FIG. 4 shows the ordinary clothing 5, the hip pads 6, the coccyx pads 7 and the headed screws 8, 9, 10, 11, 12, 14 securing the pads 6, 7 to the ordinary clothing 5. The subject is using the present invention during participation in a high impact sport.

It will be appreciated that the headed screws and cylindrical nuts come in a wide variety of materials and styles. The only requirement is that they have a clamping means to releaseably hold the protective pads to the clothing without damaging the clothing.

The subject invention is not limited to the style of hip and coccyx pad shown in the drawings. This is merely representative of the many styles of pads including rigid pads, flexible pads, articulated pads, soft pads, and any combination of the foregoing types.

It will be readily apparent that the subject invention can also be used for thigh, shin, back, shoulder and/or for attaching any other pads to the appropriate areas of the wearer. The subject invention allows the pads to be releaseably attached to ordinary clothing without damaging the clothing.

The present invention may be subject to many modifications and changes without departing from the spirit or essential characteristics thereof. The present specification should therefore be considered in all respects as illustrative and not restrictive of the scope of the present invention as defined by the claims.

What I claim is:

1. A hip and coccyx protective pad attachment to ordinary clothing, positioned about the hips and coccyx the protective pad attachment providing protection to the hip and coccyx areas of the body, said pad attachment comprising:

protective pads including one or more hip pads and at least two coccyx pads, each hip and coccyx pad having at least one pre-formed holes extending completely therethrough; and one or more fasteners including a headed screw and a cylindrical nut spaced along one of a dynamic center of each pad and the general periphery and the dynamic center of each pad, wherein the cylindrical nut includes a shaft and end cap, the shaft is inserted through the at least one pre-formed holes of the pad with the end cap being placed against the pad and the headed screw being inserted trough the at least one pre-formed holes of the clothing and received by the shaft for applying a clamp load to the clothing and the pad without damaging the clothing and the pad, the pad being further configured to protect the hip and coccyx areas of the body and to allow movement of the hip and coccyx areas of the body.

2. The protective pad attachment of claim 1 wherein each said fastener comprises:

opposing clothing gripping threaded joints, and clamping means adapted to selectively open and close the said joint.

3. The protective pad attachment of claim 1, wherein the cylindrical nut completely covers the threaded portion of the headed screw.

4. The protective pad attachment of claim 1, wherein the shaft threadedly engages the headed screw.

5. A method for applying a hip and coccyx protective pad attachment to clothing, positioned about the hips and coccyx, the method comprising the steps of:

protecting the hip and coccyx areas of the body including one or more hip pads and at least two coccyx pads, each hip and coccyx pad having at least one pre-formed holes extending completely therethrough;

positioning one or more fasteners including a headed screw and a cylindrical nut spaced along one of a dynamic center of each pad and the general periphery and the dynamic center of each pad;

attaching the cylindrical nut through the at least one pre-formed holes of the pad with the end cap being placed against the pad and the headed screw through the at least one pre-formed holes of the clothing and received by the shaft applying a clamp load to the clothing and the pad without damaging the clothing and the pad; and allowing movement of the hip and coccyx areas of the body.

6. The method of claim 5, wherein each fastener comprises a headed screw having a threaded portion and a cylindrical nut, and the cylindrical nut is configured to completely cover the threaded portion of the headed screw.

* * * * *